United States Patent [19]

DiMatteo et al.

[11] Patent Number: 4,700,415

[45] **Date of Patent: * Oct. 20, 1987**

[54] RECLINABLE WHEELCHAIR APPARATUS

[75] Inventors: Paul DiMatteo, Huntington; Charles F. Chubb, Brookville, both of N.Y.

[73] Assignee: Nova Technologies, Inc., Hauppauge, N.Y.

[ * ] Notice: The portion of the term of this patent subsequent to Jul. 14, 2004 has been disclaimed.

[21] Appl. No.: 764,941

[22] Filed: Aug. 12, 1985

Related U.S. Application Data

[63] Continuation-in-part of Ser. No. 731,533, May 7, 1985.

[51] Int. Cl.[4] ..... A61G 7/08

[52] U.S. Cl. ..... 5/81 R; 5/81 C; 5/88; 297/DIG. 4

[58] Field of Search ..... 5/60, 61, 66, 67, 81 R, 5/81 B, 81 C, 88, 90, 486, 487; 297/330, DIG. 4, DIG. 6

[56] References Cited

U.S. PATENT DOCUMENTS

| | | | |
|---|---|---|---|
| 716,886 | 12/1902 | Goode | 5/81 B |
| 2,536,707 | 2/1951 | Allyn | 5/81 B |
| 2,984,842 | 5/1961 | Richards | 5/61 |
| 3,593,351 | 7/1971 | Dove | 5/81 R |
| 3,654,643 | 4/1972 | Clanan | 5/81 B |
| 3,786,523 | 1/1974 | Sele | 5/81 B |
| 3,854,152 | 12/1974 | Chez | 5/81 C |
| 3,967,328 | 7/1976 | Cox | 5/81 R |
| 4,011,609 | 3/1977 | Bethlen | 5/81 B |
| 4,287,619 | 9/1981 | Brewer et al. | 5/90 |
| 4,383,713 | 5/1983 | Roston | 297/DIG. 6 |
| 4,479,993 | 10/1984 | James | 5/61 |

FOREIGN PATENT DOCUMENTS

| | | | |
|---|---|---|---|
| 2100122 | 12/1982 | United Kingdom | 5/61 |

*Primary Examiner*—Gary L. Smith
*Assistant Examiner*—Michael F. Trettel
*Attorney, Agent, or Firm*—Max Fogiel

[57] ABSTRACT

A reclinable wheelchair which operates in conjunction with a compatibly equipped bed to transport a prone person between the bed and the reclined wheelchair alongside the bed. The back rest can be raised and the leg rest of the wheelchair can be lowered to place the person in a sitting position. Provisions are included for use with a toilet.

29 Claims, 26 Drawing Figures

RECLINABLE WHEELCHAIR APPARATUS

BACKGROUND OF THE INVENTION

The present application is a continuation-in-part of the parent application Ser. No. 731,533 filed May 7, 1985.

The process of transferring an invalid person from a hospital bed to a wheelchair, to a commode, or to a toilet in a hospital, nursing home, or home, or assisting such a person in such a transfer, often involves more than one person, is labor intensive and can be costly. The task frequently requires considerable strength and is occasionally a source of injury to the patient or helper. These problems often are the major factors that cause a person to be hospitalized or moved to a nursing home, rather than being cared for at home. They also increase the cost of caring for persons in hospitals and nursing homes.

Accordingly, it is the primary object of the present invention to provide a wheelchair which, in combination with a suitably equipped bed, comprises an arrangement whereby a person can be easily, safely, and comfortably transferred between a bed and a wheelchair positioned alongside the bed with no effort on the part of the person, and without requiring more than moderate physical strength or skill from an attendant.

It is another object of the present invention to provide an arrangement for the person to make use of a commode in the wheelchair or use of a toilet after the wheelchair has been positioned over a toilet bowl.

It is still another object of the present invention to provide a wheelchair which is suitable for use in a home, or outdoors, as well as in a hospital or nursing home.

It is a further object of the present invention to provide a means of transferring a person from a bed to a wheelchair without requiring additional space beyond the end of the bed.

Additional objects and advantages of the present invention will become evident from the following description of specific embodiments when read in connection with the accompanying drawings.

DESCRIPTION OF THE PREFERRED EMBODIMENTS

Figure 1:
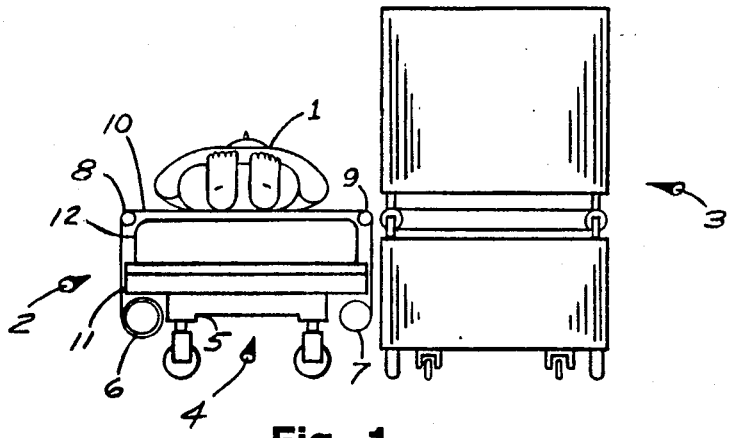
FIGS. 1 through 6 are schematics showing the operation of this invention.

FIGS. 1 through 6 illustrate schematically the principles used to transport a person 1 from a bed 2 to a wheelchair 3.

The bed 2 consists of a conventional bed 4 as found in a home or institution such as a hospital or nursing home. An elevating device 5, either manual or power driven, as is found on hospital type and some home beds, is used to raise or lower the bed 2 to the proper height to perform the required operations. Alternatively, the bed may be blocked up to the proper height and left there for the duration of the patient's use.

Also attached to the conventional bed 4 is an arrangement for transporting a person 1 from a position on the bed to and beyond the edge of the bed.

This arrangement contains a right side roller 6 (shown in FIG. 1) whose length is approximately equal to the length of the bed, and which is mounted to the bed frame at the right side of the bed. A similar left side roller 7 is positioned at the left side of the bed. (Right and left are from the patient's point of view.) A specially designed bed sheet 10, approximately equal in width to the length of the bed and equal in length to several multiples of the width of the bed, is fastened to and partially rolled up on the right side roller 6, while the other end is fastened to the left side roller 7 at the left side of the bed.

Although not a requirement of this invention, it is desirable to keep the width of the modified bed 2 as narrow as possible. For this reason, the rollers 6 and 7 are located under the main bed frame members 11. To ease the transport of the sheet 10 over the mattress 12, a right corner roller 8 and left corner roller 9 are mounted in a way not shown, to the bed frame 11. These rollers 8 and 9 can be of relatively small diameter and covered with a soft material over a stiff core. The top surface of these rollers is approximately level with the top surface of the bed 2.

Mechanical power is provided from such sources as electric motors or hand cranks (not shown) for driving the two rollers to wind up the sheet on one roller, while allowing it to unwind from the other so as to move the sheet over the surface of the mattress 12 and thereby transport a reclining person 1 from a position on the bed 2 to and beyond the side of the bed.

The wheelchair 3 shown in FIG. 1 alongside the bed 2 is in an upright chair position. A mechanism allows the chair 3 to assume a reclining position as in FIG. 2. The bed 2 is adjusted by mechanism 5 to be the same height as the chair 3.

The wheelchair 3 is equipped with two sets of rollers 14 and 15 on each side. The rollers may have soft outer layers of material to enable comfortable patient transfer. These sets of rollers are hinged in three sections to allow them to articulate with the chair. Extending around these rollers 14 and 15 is a set of bands of material which form a sheet 13 extending across the chair. The sheet 13 comprises three separate bands, each of which may be an endless belt (a conveyor belt) as shown in FIGS. 1 through 6, or may be similar to the sheet 10 on the bed, extending between two rolls on wind-up rollers. Construction of the rollers and sheets is discussed subsequently.

The wheelchair 3 is held in position beside the bed 2 by wheel locks (not shown) or may be locked to the bed by a latching mechanism (not shown).

Figure 3:
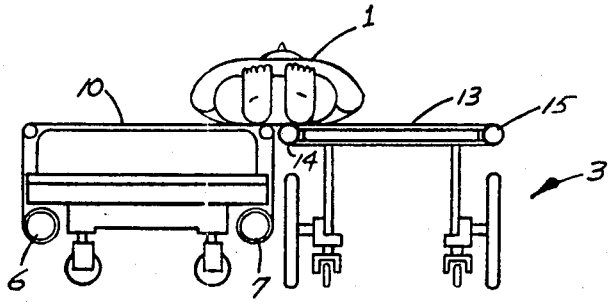
Figure 4:
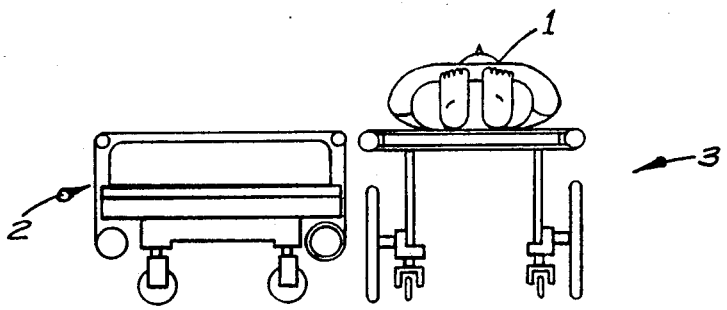

In FIG. 3, the sheet 10, pulled by roller 7 turning in a clockwise direction transports the patient 1 off the side of the bed as roller 6 turns freely or is driven to provide slack. Sheet 13 on the wheelchair 3 is driven to also move in the same direction and velocity as sheet 10 on the bed, and thereby completes the transfer of the patient from bed 2 to wheelchair 3 in a smooth and continuous manner. The result is as shown in FIG. 4.

Figure 5:
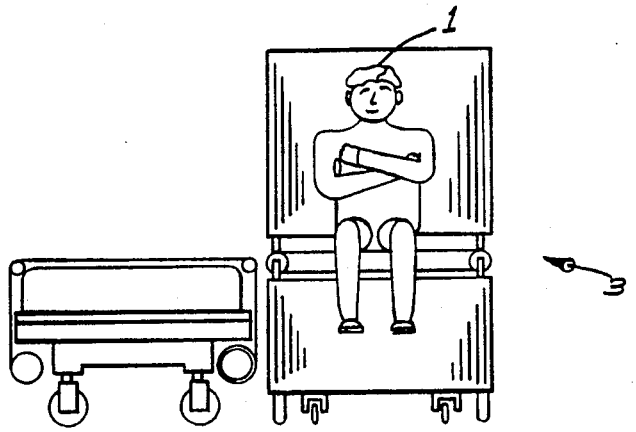
Figure 6:
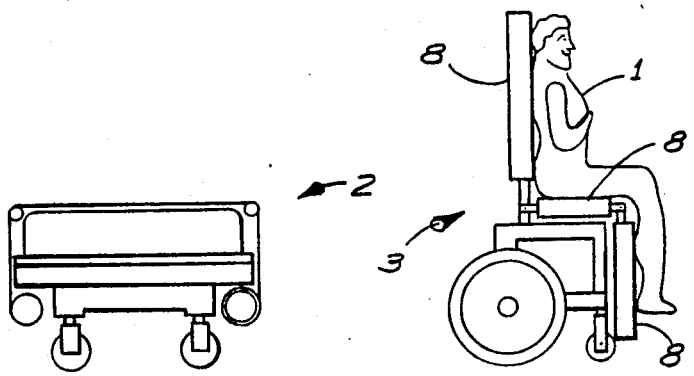

In FIG. 5, the wheelchair 3 is shown elevated into an upright chair position with the patient 1 seated thereon. In FIG. 6, the wheelchair 3 with patient 1, is shown removed from bed 2. The chair with the patient may be moved where required. If a toilet access opening (not shown) in sheet 8 is positioned properly during the transfer operation, the seated patient may be wheeled to, and positioned over and able to use, a commode or standard toilet in the normal manner.

To return the patient to the bed, the sequence of steps shown is reversed from FIG. 6 to FIG. 1, except that in FIG. 3, roller 6 is rotated counter-clockwise, roller 7 is allowed to rotate freely and sheet 13 is driven to the left.

Figure 7:
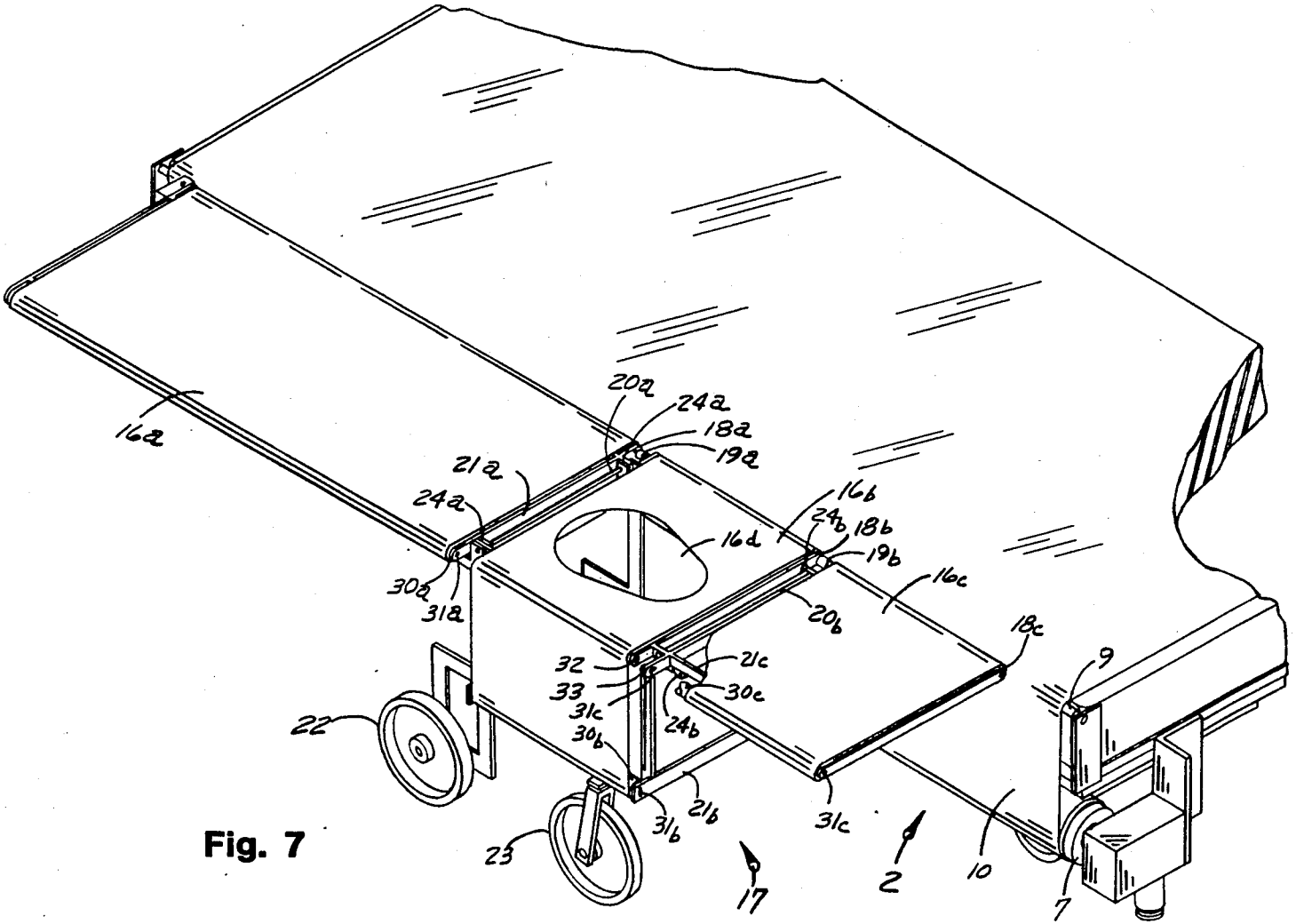
FIG. 7 is a partial sectional perspective view of one form of this invention using an endless band of material over the surface of the wheelchair.
Figure 8:
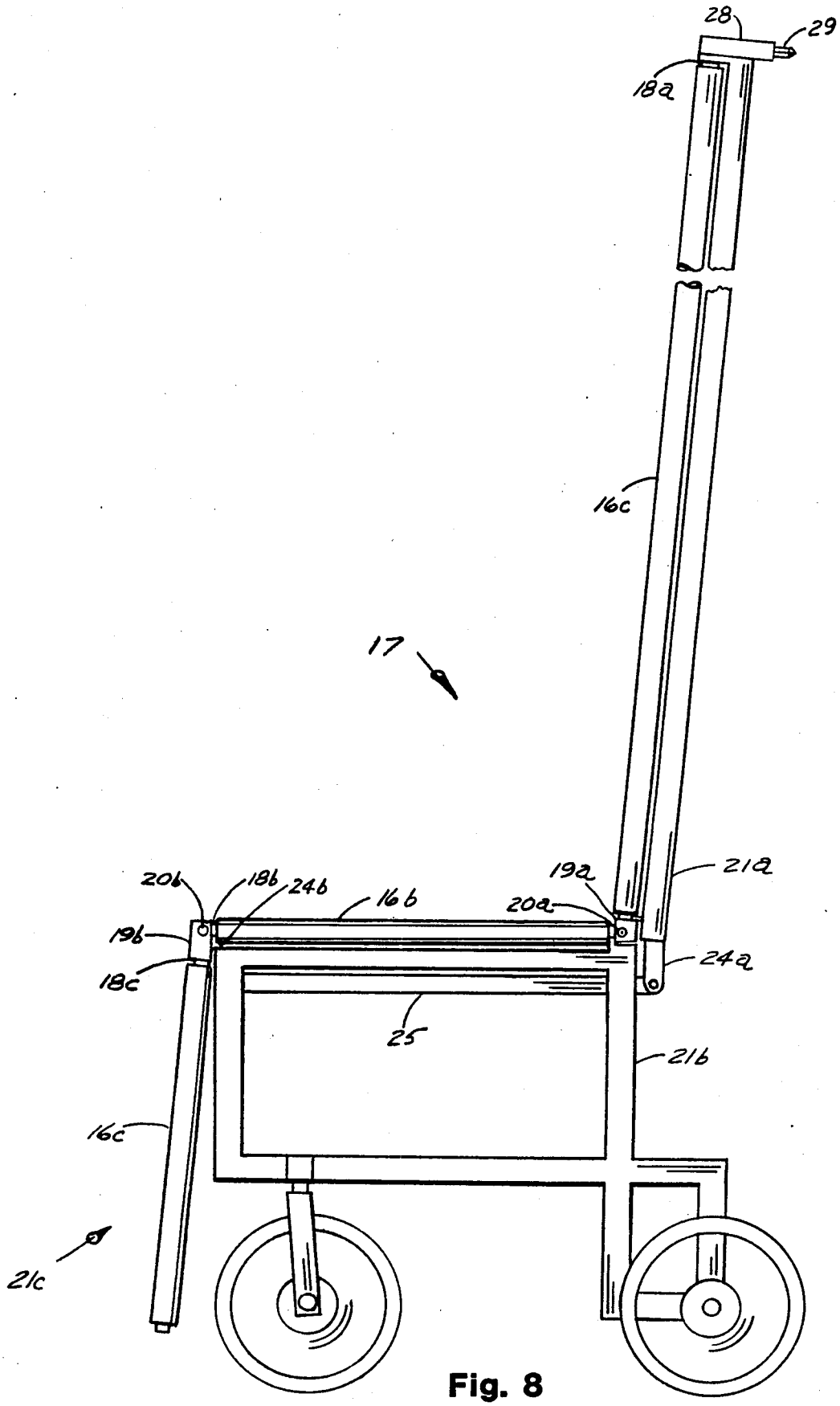
FIG. 8 is a side elevation view of the wheelchair in its upright chair position.
Figure 9:
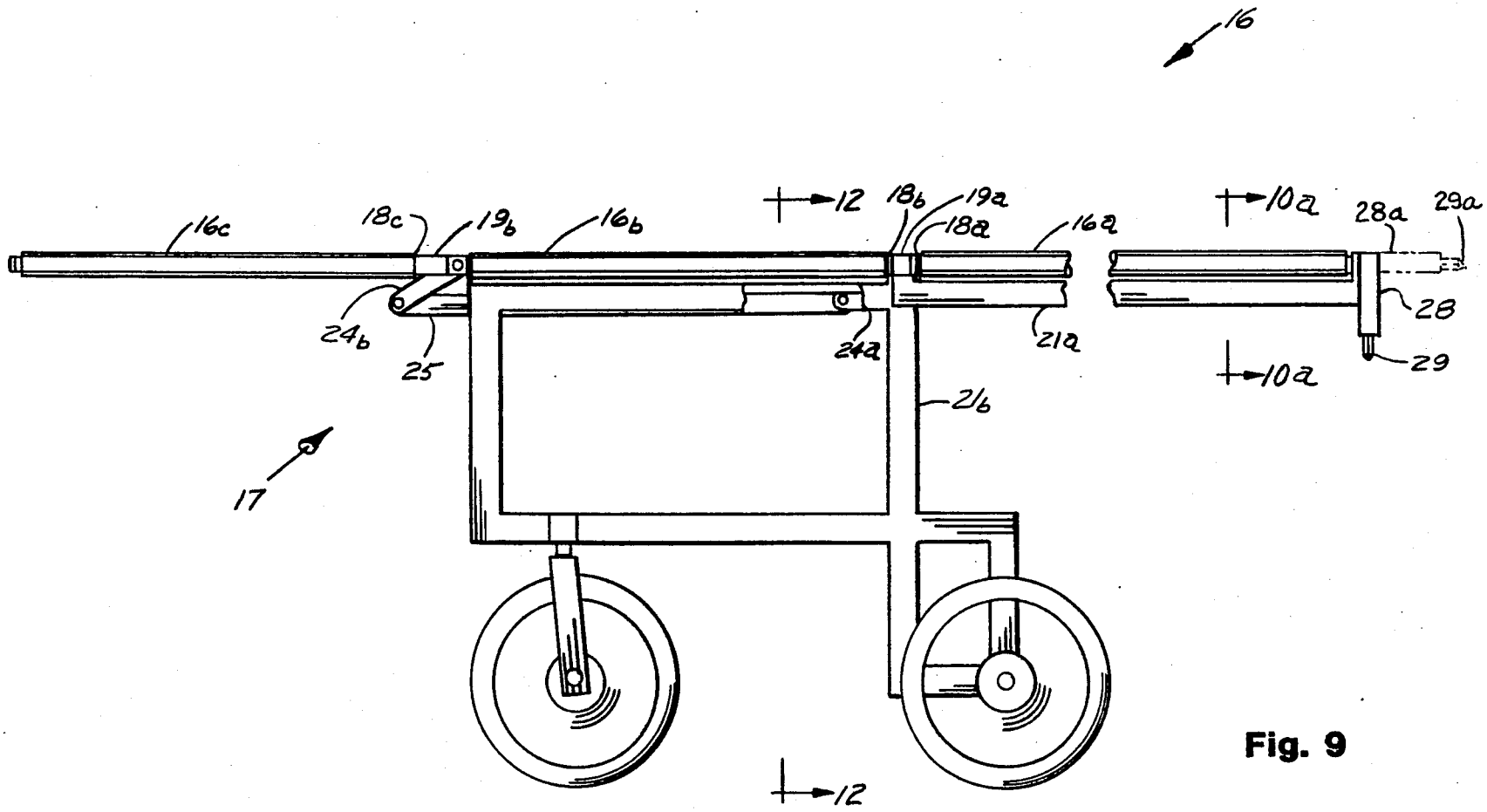
FIG. 9 is an elevation view of the wheelchair in its reclining position.
Figure 10A:
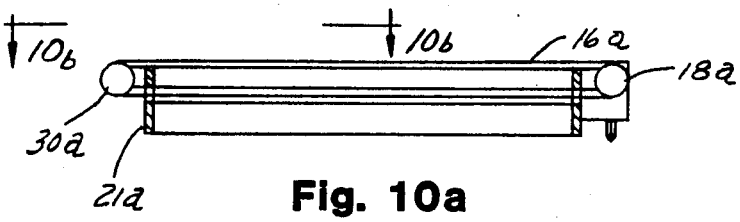
FIG. 10*a* is a sectional view through FIG. 9 showing the back support section.
Figure 10B:
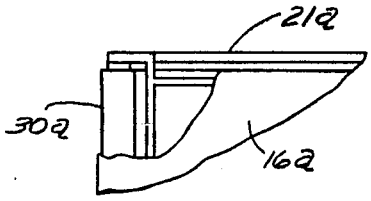
FIG. 10*b* is a partial plan view of FIG. 10*a* showing a back roller.

FIG. 7 is a partial sectional perspective view of a wheelchair 17 which contains three endless belts, back section belt 16*a*, seat section belt 16*b* and foot section belt 16*c*. In FIG. 7 the wheelchair 17 is shown reclined alongside a bed 2. FIGS. 8 and 9 are side elevation views of wheelchair 17 in an upright chair position and a reclined position, respectively. FIG. 10*a*, which is a sectional view through the back frame section, and FIG. 10*b*, which is a partial plan view, show the arrangement of rollers 30*a* and 18*a*.

FIG. 7 shows the wheelchair structure or frame comprising three parts: the back frame 21*a*, the seat frame 21*b* and the foot frame 21*c*. The seat frame 21*b* is connected to the back frame 21*a* through axle 20*a* and to the foot frame 21*c* by axle 20*b*. The frames are of adequate strength and stiffness to support the patient. Attached to seat frame 21*b* are a pair of wheels 22 and a pair of castered wheels 23 arranged in a suitable manner to provide stability to the wheelchair 17 in seated and reclined positions and with or without a patient thereon. These wheels 22 and 23 are also to provide suitable mobility to the wheelchair 17 when the chair is in an upright position as shown in FIG. 8.

FIG. 8, which is a side elevation view of the upright weelchair, shows a linkage for raising and lowering the foot frame 21*c*. The axles 20*a* and 20*b* are parallel to each other and pass through suitable bearings in seat frame 21*b*. The axle 20*a* is rigidly attached to back frame 21*a*. In a similar manner, axle 20*b* is fastened to foot frame 21*c*. As shown in FIG. 9, two links 24*a* and 24*b*, which may be of diverse shapes but with similar pivot points and pivot point spacing, are respectively fastened rigidly to axles 20*a* and 20*b*. They are pivotly connected by links 25. Links 25, 24*a*, 24*b* and frame 21*b* form an approximate 4-bar parallelogram linkage, one of which is shown on each side of the wheelchair. It is evident that raising frame 21*a* from the reclined position shown in FIG. 9 to that in FIG. 8 will lower the foot frame 21*c* correspondingly.

Figure 12A:
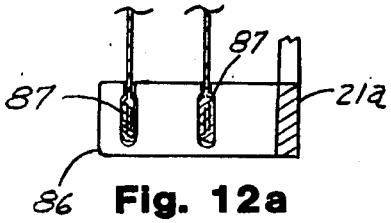
FIG. 12*a* is a partial sectional view showing a belt guidance block.
Figure 12:
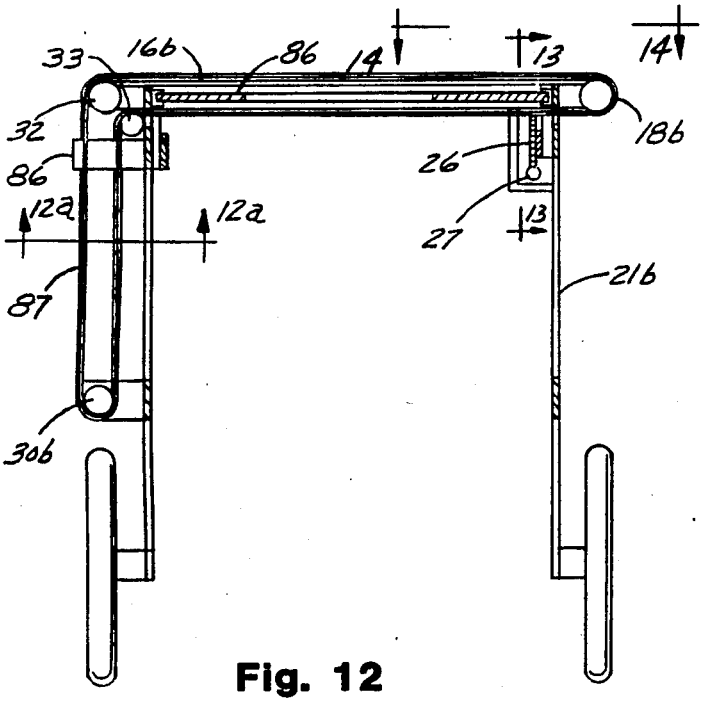
FIG. 12 is a sectional view through FIG. 9 showing the seat section.
Figure 13:
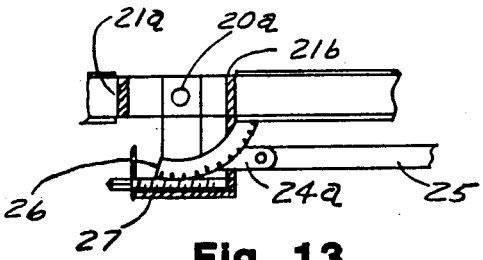
FIG. 13 is a partial sectional view through FIG. 12 showing a hinge joint.

FIGS. 12 and 13 show a self-locking drive mechanism to move the foot and back frames 20*a* and 20*c*, in which a worm gear segment 26 is fastened to axle 20*a* and driven by a worm 27. These are to have a suitably high gear ratio and friction, as is well known in the art to prevent back driving. To drive the worm 27, a number of alternative power sources (not shown) may be used, including but not limited to, electric motors, or hand cranks. These may be permanently attached to the wheelchair, installed as required for each use, or fastened to the bed 2. In the latter arrangement, the wheelchair is maneuvered into position at the bed to engage a shaft coupling (not shown) on the wheelchair with a mating coupling (not shown) connected to a power source on the bed. Alternatively, the worm drive may be omitted and the back rest may be raised or lowered manually and locked in position with a manual locking mechanism (not shown).

In the embodiment of the invention shown in FIGS. 7 through 14, back section roller 18*a*, seat section roller 18*b*, and foot section roller 18*c* are the belt drive rollers. These rollers are suitably mounted on their respective frame sections. FIG. 7 shows the back and seat rollers 18*a* and 18*b* connected by universal joint 19*a* and the seat and foot rollers connected by universal joint 19*b*. These joints must be able to bend 90 degrees but they do not have to rotate or transmit torque except when their respective shafts are approximately coaxial. The term universal joint as used herein refers to any of the commercially available types such as the CARDAN joint and includes any splines or other sliding couplings needed to keep the bending axis concentric with the axles 20*a* and 20*b* of the chair. Other types of coupling devices which provide a driving capability when the shafts are approximately coaxial and which allow up to 90 degree bending, can be used also.

The drive mechanism 28 for the rollers 18 is shown at the top of the back roller 18*a* in FIG. 8. It is shown as a right angle gear drive, but other suitable drives, including direct drives, can be used. In this case, it is shown to be powered by a driving shaft 29 which couples to an external controlled power source. This external source, not shown, may be attached to the bed 2 in such a position that as the back frame 20*a* is lowered, shaft 29 will engage said drive. Alternatively, a different arrangement may be used such as driving shaft 29*a* on FIG. 9 coupled to drive 28*a*, which can be conveniently driven by a hand crank (not shown) or a portable power drive unit such as a variable speed hand held electric drill (not shown). Means for engaging shafts, developing torque and transmitting said torque are well known in the art and for this reason will not be discussed further.

As shown in FIG. 7, the sheet, or endless belt 16, is made up of three sections. This facilitates the wheelchair articulation and affords the opportunity of making the center section of the endless belt 16*b* long enough to provide a solid seat section for normal sitting and a pair of toilet access openings 16*d* for use as nature requires. All three belts 16*a*, 16*b*, and 16*c*, have tension rollers 30*a*, 30*b*, and 30*c*, respectively, with conventional means 31*a*, 31*b*, and 31*c* for adjusting tension and tracking of their respective belts. FIG. 12, which is a sectional front view through the seat section of wheelchair 17, shows additional idler rollers 32 and 33 which help provide the additional belt path length needed for the toilet access openings in belt 16*b*. For applications in which the toilet access feature is not needed, the additional path length shown in FIG. 12 can be eliminated, and the simple 2-roller conveyor belt configuration shown in FIGS. 1 through 6 can be used.

As seen in FIG. 7, if it is desired that the patient be transferred onto wheelchair 17 in position to use the toilet access openings 16*d*, belt 16*b* must be in the proper position when the patient reaches roller 18*b* on the side of the wheelchair 17. Timing marks or other means (not shown) on belt 16*b* may be employed to aid the attendant in positioning the belt for patient transfer.

Figure 11A:
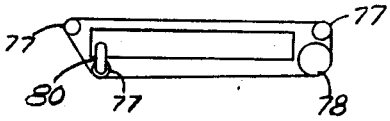
FIG. 11*a* is a schematic showing a belt configuration using multiple idler rollers.
Figure 11B:
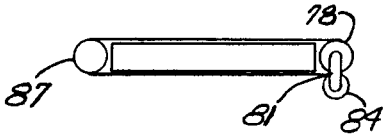
FIG. 11*b* is a schematic showing a belt configuration with driver and pressure rollers.
Figure 11C:
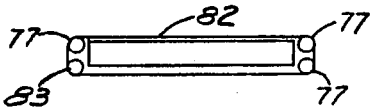
FIG. 11*c* is a shematic showing a belt configuration with a sprocket wheel drive.

It is clear that many variations in roller and drive mechanisms can be used to effect motion of the belts across the surface of the wheelchair. FIG. 11*a* shows one such schematic arrangement with belt 79 passing around a drive roller 78 and multiple idler rollers 77, one of which is mounted on a support 80 that is adjustable for controlling belt tension. FIG. 11*b* shows belt 79 passing around idler roller 87 and between a drive roller 78 and a pressure roller 84 with adjustable support 81 to control the drive roller pressure on the belt. FIG. 11*c* shows a belt 82 with sprocket holes along one or both edges which passes over a matching sprocket wheel driver 83 and multiple idler rollers 77. Alternatively, the several idler rollers may be replaced by smooth slippery support members over which the several belts slide.

The wheelchair may be equipped with additional attachments such as arm rests, foot supports and support straps to aid the patient in seating. These are not shown, but, as they are standard accessories on many commercial wheelchairs, anyone skilled in the art may adapt them to this chair. Also, for the patient's comfort, soft or rigid supports such as seat support 86, removably attached to frame 21*b*, shown in FIG. 12, may be provided just under the belt surface. Support 86 may be continuous, or, as shown, may incorporate a toilet seat and a replaceable cover or parts (not shown). These supports would be attached to the adjacent frame sections.

Conventional techniques (not shown) are used to insure proper belt tracking, including roller flanges or crowning. FIG. 12 shows an optional guidance member 86 which is used, if required, to provide additional constraint for belt guidance at critical points along the belt path. As shown in a partial sectional view in FIG. 12*a*, the guidance member 18 has a shaped restraining groove with a narrow outer portion through which the center portion of the belt passes, and a wider inner portion through which a thickened edge 87 of the belt 16 is constrained to pass. Such guidance members can be used on opposite edges of a belt, as needed, and may contain one or more grooves.

Figure 15:
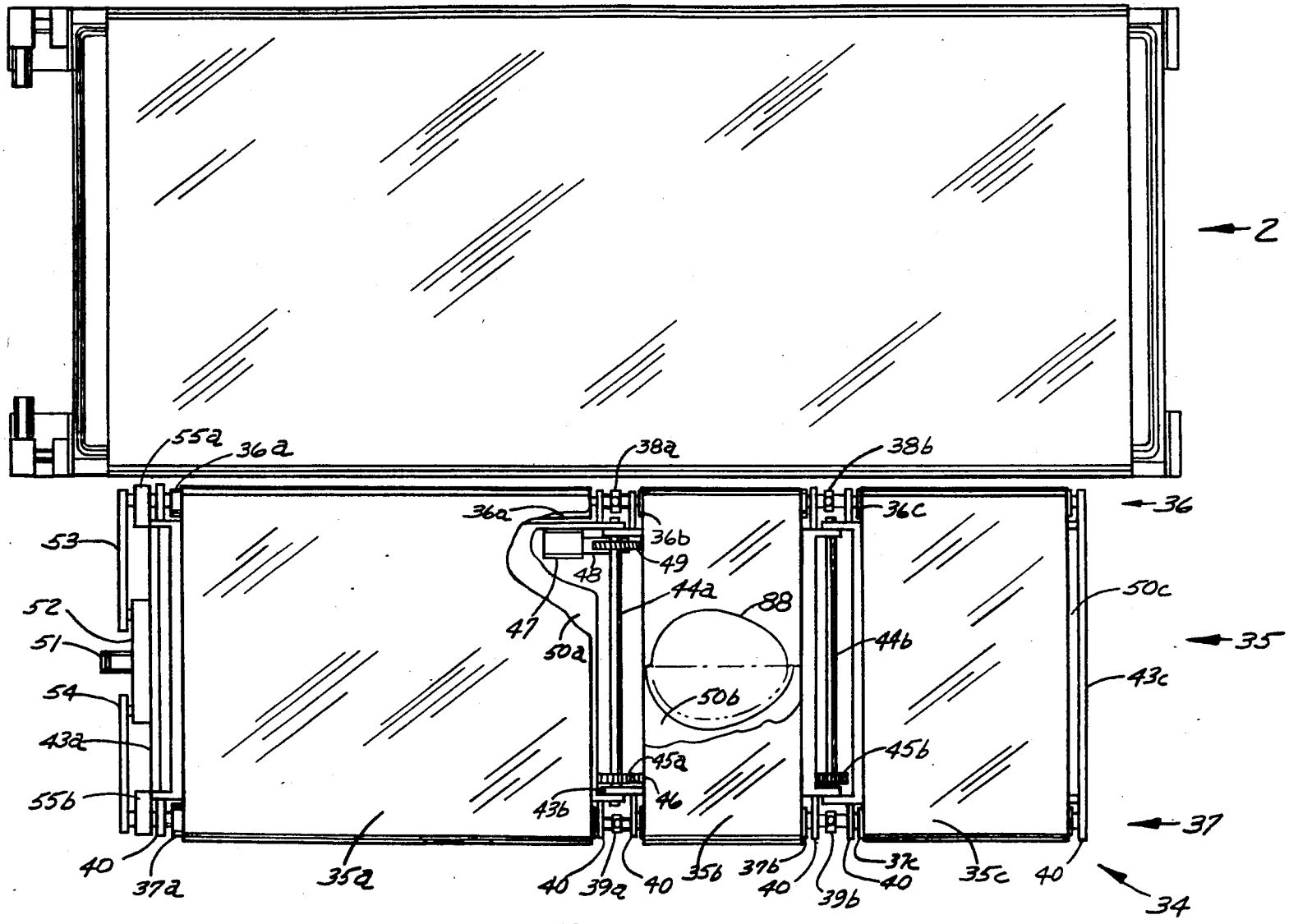
FIG. 15 is a plan view of a bed with a wheelchair equipped with a sheet of material over its surface with wind-up rollers.

FIG. 15 is a plan view of an arrangement of a bed 2 with a wheelchair 34 positioned beside it. In this arrangement, the top surface of wheelchair 34 is covered with three separate sheet bands 35*a*, 35*b* and 35*c* which are attached to corresponding pairs of rollers 36*a* and 37*a*, 36*b* and 37*b*, 36*c* and 37*c*. These rollers are mounted to opposite sides of their respective frame members 43*a*, 43*b* and 43*c*. The three rollers on each side are coupled together with left back roller 36*a* being connected to universal joint 38*a* that is connected in turn to left seat roller 36*b*—connected to universal joint 38*b*—connected in turn to left foot roller 36*c*. In a similar manner, universal joints 39*a* and 39*b* connect rollers 37*a*, 37*b* and 37*c*. These joints are required to rotate only when their shafts are approximately coaxial, but they must be able to bend 90 degrees and may be any type, such as the CARDAN joint or other. The term "universal joint" herein refers to the actual joint plus any required splines, or other sliding couplings. As indicated earlier, other types of coupling devices also can be used.

The sheet sections 35*a*, 35*b*, and 35*c* are wide enough to substantially cover their respective frame members 43*a*, 43*b* and 43*c* and are longer than several widths of the chair 34. The sheets 35 are fastened to and partially wrapped around one roller set 37 and are fastened to and wrapped several times about the other roller set 36, and are pulled taut between the rollers.

Figure 14:
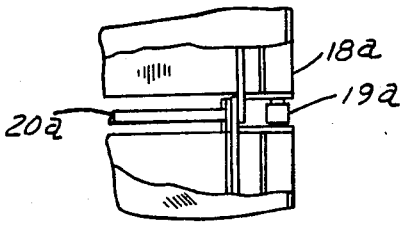
FIG. 14 is a partial plan view of FIG. 12 showing the mechanism used to elevate back rest and leg rest.

FIG. 15 shows also the mechanism for elevating the back frame 43*a* and the foot frame 43*c*. Back frame 43*a* is connected rigidly to axle 44*a* which in turn rotates in seat frame 43*b*. Likewise, foot frame 43*c* is connected rigidly to axle 44*b* which rotates in seat frame 43*b*. Both axles 44*a* and 44*b* are parallel and have sprocket wheels 45*a* and 45*b*, respectively, affixed to them. Motor 47 is shown attached to worm 48 which acts on worm gear 49, in a similar fashion as shown in FIG. 14, to raise back rest frame 43*a* and rotate axle 44*a*. Sprocket wheel 45*a* is connected by chain 46 or similar device to sprocket wheel 45*b*, so that when the back 43*a* is raised, axle 44*a* with sprocket wheels 45*a* rotates causing sprocket wheel 45*b* and axle 44*b* to rotate and raise or lower the foot frame 43*c* as required. The universal joints 38*a*, 38*b*, 39*a* and 39*b* bend about the center line of the axles 44*a* and 44*b*.

Figure 18A:
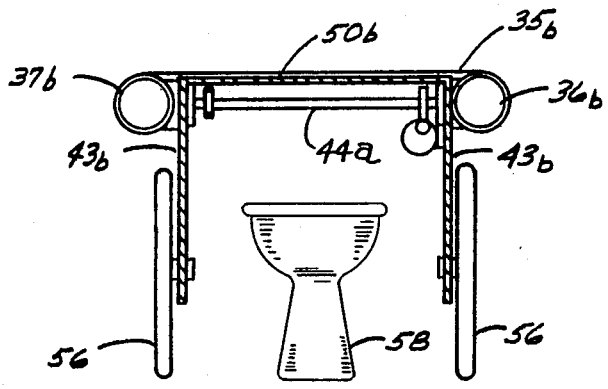
FIG. 18*a* is a front sectional view through FIG. 16 showing the seat section of the wheelchair positioned over a toilet.

When a patient is to be transfered onto the chair, one roller set 37*a*, 37*b* and 37*c* winds up the sheets 35*a*, 35*b* and 35*c* while the other roller set 36*a*, 36*b* and 36*c* unrolls freely and releases the sheets at the same rate. In this case, some provision is required to support the patient's weight. This support is provided by supports 50*a*, 50*b*, and 50*c* under each respective sheet 35*a*, 35*b* and 35*c*. These supports, which are attached to frame members 43*a*, 43*b*, and 43*c*, may be padded as required. The center support 50*b* requires an opening to allow the chair to be used over a toilet 58 as shown in FIG. 18*a*, or a replaceable chamber pot 85 shown in FIG. 18*b*, which may be mounted on supports attached to frame 43*b*.

To drive the rollers in the way just described, an electric motor 51, or other source of torque, drives a gear box 52 that rotates pulley 53 counter-clockwise and pulley 54 in a clockwise direction. When clutch 55*b* is engaged, then the roller 37 pulls the patient on to the chair from the bed and when clutch 55*a* is engaged, the patient is returned to the bed.

In this scheme, only one of the two clutches, 55*a* and 55*b* is engaged when the motor is running. The motor 51 may be replaced, or supplemented by a hand crank or a portable power source. The location of this drive may be on any part of the chair where it does not interfere with the operation of other features, and all rotating members should have suitable safety guards in place for operation. The addition of conventional auxiliary foot rests, side rails and restraining straps, while not shown, may be accomplished by one skilled in the art.

Alignment marks may be advantageous in positioning a patient directly over the toilet access opening 88 in sheet 35*b*, but for sake of clarity, are not shown. Bands 35*a*, 35*b* and 35*c* are of sufficient length to allow a continuous section of sheet 35*b* to be positioned under the patient, for normal seating, when the toilet access opening is not being used.

Figure 16:
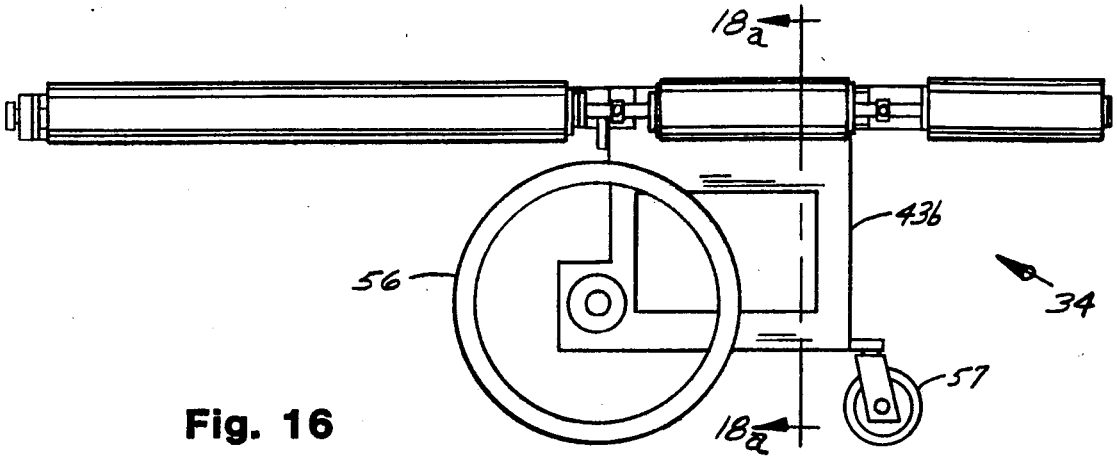
FIG. 16 is a side elevation view of the wheelchair shown in FIG. 15, in its reclining position.
Figure 17:
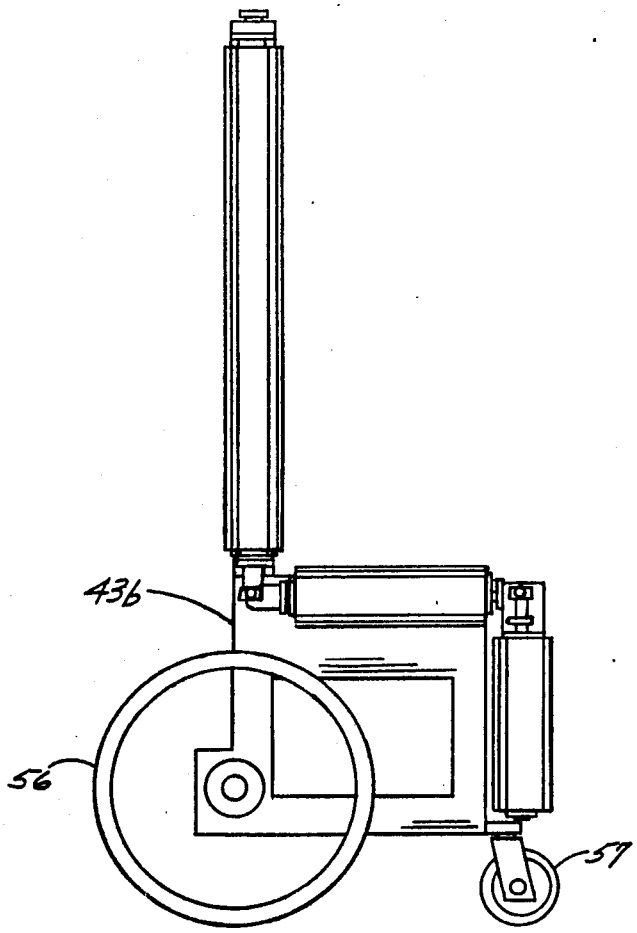
FIG. 17 is a side elevation view of the wheelchair in FIG. 15 in its upright chair position.

FIGS. 16 and 17 are side elevation views of the wheelchair in its reclining and upright chair positions, respectively. As seen in FIGS. 16 and 17, the seat section frame 43*b* also supports wheels 56 and castered wheels 57 which are placed to provide stability and mobility without interfering with the patient transfer operation. FIG. 18*a*, which is a front sectional view through the seat section, shows the rear of the seat frame 43*b*, to be free of obstructions to allow the wheelchair in its upright chair position to be positioned over a standard toilet 58.

Figure 18B:
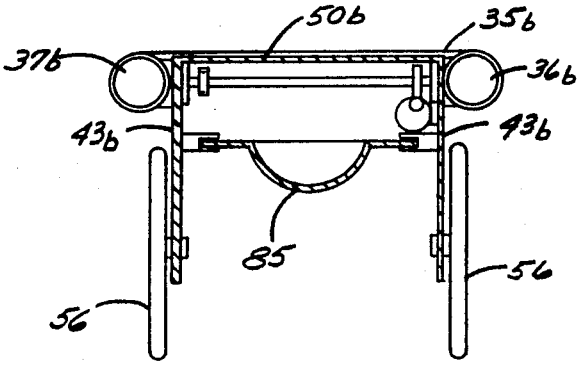
FIG. 18*b* is similar to FIG. 18*a* except that it shows a replaceable chamber pot in the wheelchair.

FIG. 18*b* is similar to 18*a*, except that it shows an optional replaceable chamber pot installed in the wheelchair 34 to provide a convertible commode function, also available for wheelchair 17.

The foot belt 16*c* in FIG. 7 and foot band 35*c* in FIG. 15 support only the lower portion of the patient's legs, a small portion of his total weight. For this reason, these sections of the belt may be left to rotate freely by omitting coupling 19*b* in FIG. 7 or couplings 38*b* and 39*b* in FIG. 15. As another alternative, the complete belt 16*c* or sheet 32*c* may be removed and replaced with a solid, smooth surface with a low coefficent of friction. None of these solutions are shown as they are obvious to anyone skilled in the art.

Additionally, one may want to aid the comfort of the person using this chair and ease the burden of the attendant who has to clean the chair after use. VELCRO strips, buttons, zippers or other fastening devices well known in the field may be fastened to selected areas of the various belts. These devices can be used to attach a variety of different pads to the belt such as a washable cloth pad, a waterproof protection pad, a waterproof protection pad which has an opening to match the toilet access opening and which serves as a replaceable toilet seat, a cushion, a cover pad for covering the toilet access opening, and different types of cushioning pads for protection against bedsores (decubitus ulcers) including gel pads. If the pads are flexible so that they can pass over the various rollers, the belts or bands can be positioned so that a selected pad will be moved under a person as he is transported onto the wheelchair.

Figure 2:
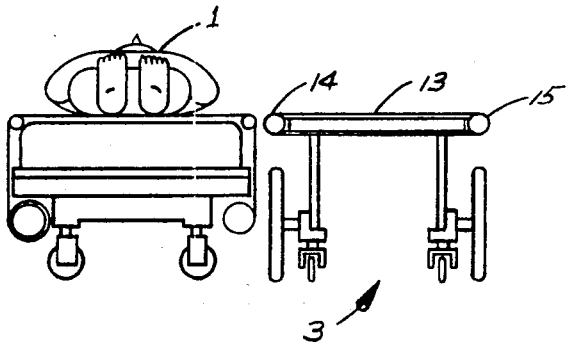

A disadvantage of the wheelchair configurations described above is that if the person 1 is using the wheelchair 3 as a seat as shown in FIG. 6, and he wishes to use the commode feature, then he must be returned to bed 2 as in FIG. 2, the belt 16 must be re-positioned for transfer onto the toilet access opening, and the patient must be re-transferred to the chair. Afterwards, the above process must be reversed to return the person 1 to a seat on the wheelchair 3.

Figure 19:
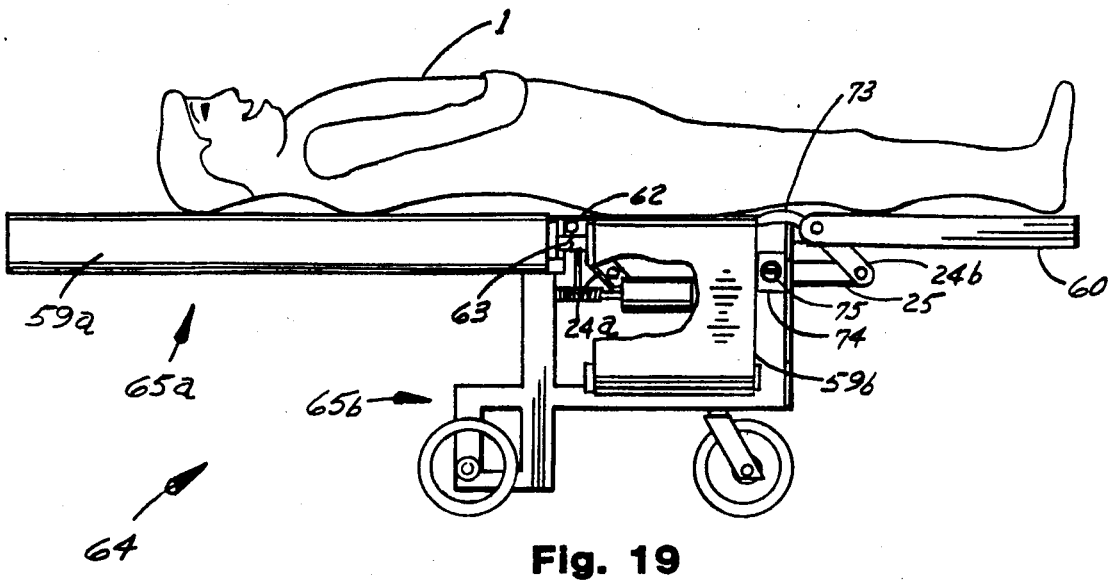
FIG. 19 is a side elevation partial sectional view of the reclined wheelchair with a separable belt drive.
Figure 20:
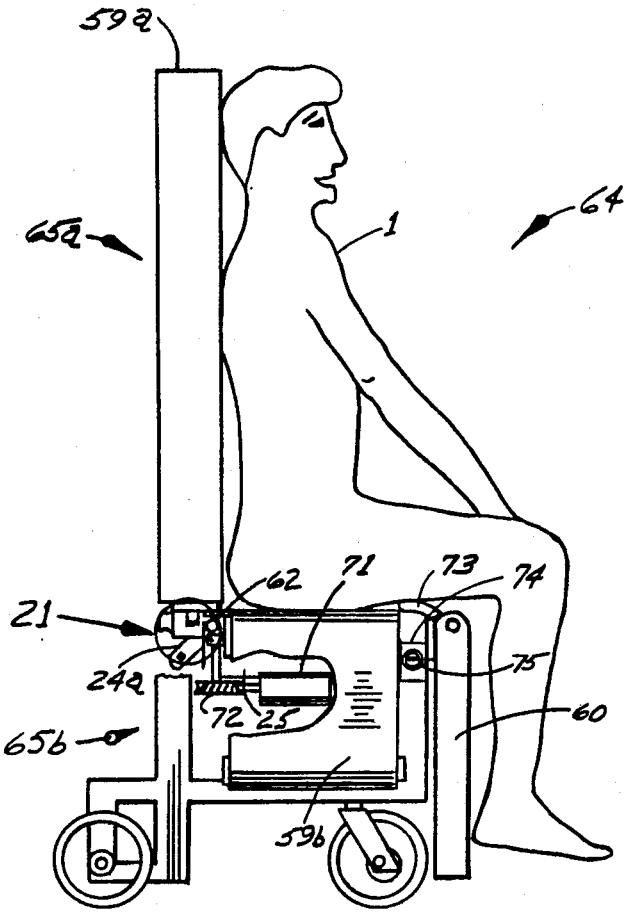
FIG. 20 is a side elevation partial sectional view of the upright wheelchair with the belt drive separated.

FIGS. 19 and 20, which are partial sectional side elevation views of the wheelchair 64 in its reclining and upright chair positions respectively, show an alternative configuration to allow a person 1 to remain seated as the seat belt 59*b* is re-positioned, while the remainder of the belt remains fixed.

Figure 21:
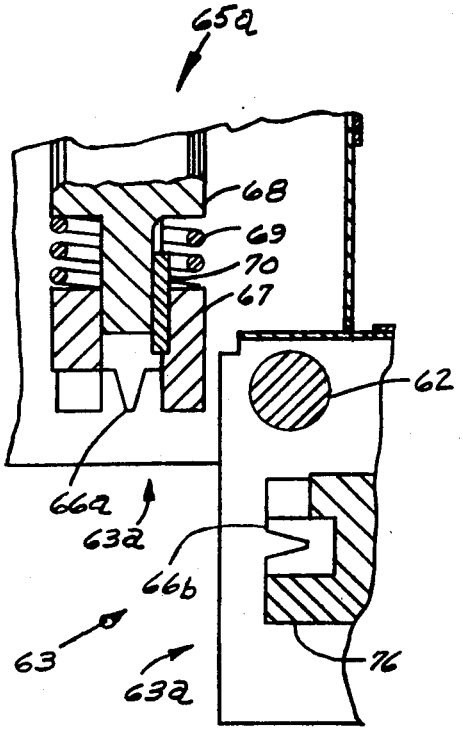
FIG. 21 is a partial sectional view of the separable belt drive mechanism.

The design of the alternate transfer mechanism is similar to that of the wheelchair 17 shown in FIGS. 7 through 14 in that it uses a set of endless belts to transfer the person and a linkage mechanism to lower the leg portion 21*c*. One change is the use of a frame with a smooth front surface 60 in place of a driven belt to support a person's lower legs 61 as he is being transferred. Alternatively, the leg support belt 16*c*, shown in FIG. 7, may be retained as a free-running belt, with universal joint 19*b* deleted. A second change is a shift of the backrest axle 62 to an offset position away from the roller drive center line. This enables the use of a clutch 63 that disengages the back and seat belts when the wheelchair is in an upright position. This clutch couples between back belt drive roller 41*a* and seat belt drive roller 41*b*. Clutch 63, which is on the far side of wheelchair 64, is visible in FIG. 19 and in the cut-out sectional view in FIG. 20. FIG. 21 is an expanded sectional view of clutch 63. As seen in FIG. 21, the clutch 63 has two parts, the driver part 63*b* and the driven part 63*a*. These parts are not mated when the wheelchair 64 is in an upright chair position as in FIG. 21. As the back assembly 65*a* pivots about axle 62 in a counter-clockwise direction to a reclining position, tooth 66*a* on the driven assembly 63*b* will mate with slot 66*b* in the drive shaft 76, which will then be coaxial with driven shaft 68. The seat belt drive roller 41*a* and back belt drive roller 41*b*, which are mounted on shaft 76 and shaft 68 respectively, will also be coaxial. In the event that tooth 66*a* and slot 66*b* are out of phase and do not mate, the driven dog 67 will slide axially on shaft 68 compressing spring 69. As the driver slot 67*b* is rotated by the roller drive, the tooth 66*a* and slot 66*b* will come into engagement and the spring 69 will cause the driven dog 67 to slide forward on shaft 68. Torque can then be transmitted to power back belt 59*a* via the key 70 between the driven dog 67 and the shaft 68.

This wheelchair belt 59 is powered by motor 71 or other suitable power source through a speed reducer 72 here shown by a series of worm and worm wheels powering the belt roller drive shaft (not shown) on the far side of FIGS. 19 and 20. With the wheelchair in a reclining position, the clutch 63 is mated and both belts 59*a* and 59*b* are driven. In a seated position, only the seat belt 59*b* is driven.

If the person 1 were to remain seated on belt 59*b* as it were operated, he would of course, be subjected to a sliding force pushing him against the removable side rails (not shown). To prevent this, the person may raise his posterior from the belt by use of his upper arms on the side rails as the belt 59*b* is actuated. This technique is not shown. Another method for someone with less upper body strength, consists of using a support 73, suitably attached to the seat assembly 65*b*. This support 73, is shaped so as to not interfere with either the patient transfer as shown in FIGS. 1 through 6, or the use of the toilet access opening 16*d* (shown in FIG. 7). When the person in FIG. 20 leans forward, either by himself or with the help of an aide, his body weight is shifted to support 73 and his posterior is raised above the belt 59 allowing it to function as described above. Alternatively, the support 73 may be a small cushion which is inserted on the wheelchair as required.

A conventional motor control box 74, connected to the motor and to a suitable electric power source, is mounted in some convenient location on the wheelchair 64 or elsewhere. It contains a 3-position spring-returned momentary action toggle switch 75 which can be deflected up or down to cause the seat belt 59*b* to be driven in one direction or the other. Alternatively, a variable motor speed control can be used in place of toggle switch 75 so that the wheelchair belt speed can be matched to the bed sheet speed to insure smooth patient transfer.

The motor control box 74 enables the person 1, or an aide to convert the wheelchair 64 from a chair function to a commode function and back to a chair function with minimum disturbance to the person 1. The same control can actuate the motion of the belts 59*a* and 59*b* for transferring the person 1 between the bed and wheelchair.

I claim:

1. A reclinable wheelchair comprising; a back rest section, a seat section, and a leg rest section; conversion means for converting the wheelchair between an upright chair position and a reclined wheelchair position having an extended horizontal surface; means for positioning said wheelchair in said reclined position side-to-side with a bed on which a person lies; said bed having a sheet of material across the bed and means for pulling said sheet of material so as to move a person lying theron to and beyond a side of said bed; strips of flexible material passing over supporting members on each side of said wheelchair; ends of said strips being attached to and wound up on rollers; constraining means for supporting said strips in predetermined positions on the wheelchair; rotational means for moving said strips in either one of two directions; and power means for driving said rotational means.

2. A reclinable wheelchair as defined in claim 1, wherein one of said strips has a toilet access opening, positionable in said seat section of said wheelchair.

3. A person transfer system comprising a reclinable wheelchair positioned side to side with a bed; said wheelchair comprising; a back rest section, a seat section, and a leg rest section; conversion means for converting the wheelchair surface between an upright chair position and a reclined wheelchair position having a horizontal surface which is stationary for overlapping the surface of the bed; means for positioning said wheelchair in a reclined position side to side with a bed; said wheelchair having continuous belts of flexible material passing over and under supporting members on each side of the wheelchair; said belts comprising top and bottom surfaces of said wheelchair; belt driving means to propel the belts in either direction; said bed having a sheet of material on which a person may lie; said sheet extending across a mattress between, and partially rolled up on, rollers neat sides of the bed; sheet driving means on the bed to roll said sheet onto one said roller and unroll the sheet from the other said roller and thereby to move the sheet across the mattress; control means acting on said sheet driving means and said belt driving means to control the speeds and directions of the sheet and belt to move a supine person between the bed and wheelchair.

4. A person transfer system as defined in claim 3, wherein a plurality of said belts are free of said belt driving means and move freely around said supporting members of the wheelchair by low friction surfaces.

5. A person transfer system as defined in claim 3, wherein said belt driving means includes a shaft connected to sprocket wheels having teeth engaging holes in each belt.

6. A person transfer system as defined in claim 3, wherein said belt driving means includes a drive roller with means for maintaining predetermined pressure between said drive roller and said belt.

7. A person transfer system as defined in claim 3, wherein said belt driving means includes a drive roller and a second roller; said belt passing between surface of said drive roller and said second roller.

8. A person transfer system as defined in claim 3, wherein said belt driving means includes a hand crank.

9. A person transfer system as defined in claim 3, wherein said power means comprises a motor and gear train with control means.

10. A person transfer system as defined in claim 3, wherein said power means comprises a motor and gear train with variable speed control.

11. A person transfer system as defined in claim 3, wherein said conversion means comprises handle and locking means for positioning manually said back rest section; and linkage means connecting said back rest section and said leg rest section so that when said back rest section is lowered, said linkage means raises said leg rest section.

12. A person transfer system as defined in claim 3, wherein said conversion means includes; a gear train connected to said back rest section; and linkage means connecting said back rest section and said leg rest section, so that when said back rest section is lowered said linkage means raises said leg rest section.

13. A person transfer system as defined in claim 3, wherein said conversion means includes a hand crank.

14. A person transfer system as defined in claim 3, wherein said conversion means includes a motor.

15. A person transfer system as defined in claim 3, wherein said means for positioning said wheelchair side-to-side with a bed comprises: wheels with casters on said wheelchair; and means on said wheelchair connecting with a member on said bed to support and hold said wheelchair fixed to said bed.

16. A person transfer system as defined in claim 3, including belt support material connected between structural members of said wheelchair.

17. A person transfer system as defined in claim 3, including idler rollers to support the belts.

18. A person transfer system as defined in claim 3, including a belt with thickened edges and edge guidance members; said belt with thickened edges sliding through guidance grooves in said edge guidance members, each of said grooves having a narrow outer slit, said belt having a center portion passing through said slit, said guidance groove having a wider inner groove, said thickened edge of said belt passing through said wider inner groove.

19. A person transfer system as defined in claim 18, comprising further a replaceable seat with attachment means below a top layer of said belt; said replaceable seat having a shape, firmness and strength for supporting comfortably a person seated on said wheelchair.

20. A person transfer system as defined in claim 3, wherein one of said belts contains two toilet access openings positionable one above the other in said seat section of said wheelchair.

21. A person transfer system as defined in claim 20, including a scale inscribed on a surface of said belt for positioning said belt when tranferring a person onto said toilet access openings.

22. A person transfer system as defined in claim 3, including a replaceable chamber pot with attachment means.

23. A person transfer system as defined in claim 3, wherein said belts have attachment means for attaching wheelchair accessories.

24. A person transfer system as defined in claim 3, including strips of material forming a closure upon coming into contact, said closure becoming reopened when said strips are pulled apart, said strips comprising means for fastening replaceable pads on said belt.

25. A person transfer system as defined in claim 3, including idler rollers at sides of said bed and having outer layers of soft material.

26. A person transfer system as defined in claim 3, wherein said conversion means comprises handle and locking means for positioning manually said back rest section; linkage means connecting said back rest section and said leg rest section so that when said back rest section is lowered, said linkage means raises said leg rest section; said conversion means including a hand crank; said means for positioning said wheelchair side-to-side with a bed comprising: wheels with casters on said wheelchair, and means on said wheelchair connecting with a member on said bed to support and hold said wheelchair fixed to said bed; a belt with thickened edges and edge guidance members; said belt with thickened edges sliding through guidance grooves in said edge guidance members, each of said grooves having a narrow outer slit, said belt having a center portion passing through slit, said guidance groove having a wider inner groove, said thickened edge of said belt passing through said wider inner groove; one of said belts containing two toilet access openings positionable one above the other in said seat section of said wheelchair; a replaceable seat with attachment means below a top layer of said belt; said replaceable seat having a shape, firmness and strength for supporting comfortably a person seated on said wheelchair; a scale inscribed on a surface of said belt for positioning said belt when transferring a person onto said toilet access openings; and idler rollers at sides of said bed and having outer layers of soft material.

27. A person transfer system comprising a reclinable wheelchair positioned side to side with a bed; said wheelchair comprising; a back rest section, a seat section, and a leg rest section; conversion means for converting the wheelchair surface between and upright chair position and a reclined wheelchair position having a horizontal surface which is stationary for overlapping the surface of the bed; means for positioning the wheelchair in a reclined position side to side with a bed; a strip of material extending laterally across and covering each section of the wheelchair; each said strip extending between and partially rolled up on two rollers; strip driving means to roll the three trips of material onto one set of rollers and unroll strips from the other set of rollers so as to move said strips of cloth together in either direction across the surface of the wheelchair; said bed having a sheet of material on which a person may lie; said sheet extending across a mattress between, and partially rolled up on, rollers near the sides of the bed; sheet driving means on the bed to roll the sheet onto one said roller and unroll the sheet from the other said roller and thereby to move the sheet across the mattress; control means acting on the sheet driving means and the strip driving means to control the speeds and directions of the sheet and strips of material so as to move a supine person between the bed and wheelchair.

28. A person transfer system as defined in claim 27, wherein one of said strips has a toilet access opening, positionable in said seat section of said wheelchair.

29. A person transfer arrangement comprising a reclinable wheelchair positioned side to side with a bed; said wheelchair comprising a back section, a seat section and a leg rest section; means for converting the wheelchair from an upright chair position to a reclined position having a horizontal surface which is stationary for overlapping the surface of the bed; said wheelchair having strips of material extending over its three sections; means for positioning the reclined wheelchair side-to-side with a bed; said bed having a mattress with a sheet of material thereon on which a person may lie; means for pulling the sheet of material over the mattress; and means for moving said strips of material over said wheelchair so as to transfer a supine person between the bed and the wheelchair; said pulling means for pulling said sheet of material being different from said means for moving said strips of material over said wheelchair.

* * * * *